United States Patent [19]

Koch

[11] 3,930,476

[45] Jan. 6, 1976

[54] INTERNAL COMBUSTION ENGINE SYSTEM

[75] Inventor: Christian Koch, Erlangen, Germany

[73] Assignee: Siemens Aktiengesellschaft, Munich, Germany

[22] Filed: Mar. 22, 1973

[21] Appl. No.: 344,042

[30] Foreign Application Priority Data

Apr. 4, 1972 Germany ..... 2216177

[52] U.S. Cl. ..... 123/119 E; 123/122 A; 123/3

[51] Int. Cl.[2] ..... F02M 31/00; F02M 7/00

[58] Field of Search .... 123/119 E, 122 R, 3, 122 A; 165/52

[56] References Cited

UNITED STATES PATENTS

| | | | |
|---|---|---|---|
| 1,795,037 | 3/1931 | Portail | 123/122 A |
| 2,116,718 | 5/1938 | Stubbs | 165/52 |
| 2,201,965 | 5/1940 | Cook | 123/3 |
| 2,221,352 | 11/1940 | Lauder | 123/122 A |
| 2,420,325 | 5/1947 | Nettel | 123/3 |
| 2,560,152 | 7/1951 | Berl | 123/122 R |
| 3,221,719 | 12/1965 | Ulrich | 165/52 |
| 3,635,200 | 1/1972 | Rundell | 123/3 |
| 3,684,738 | 8/1972 | Chen | 123/3 |
| 3,828,736 | 8/1974 | Koch | 123/3 |

FOREIGN PATENTS OR APPLICATIONS

| | | | |
|---|---|---|---|
| 434,839 | 9/1935 | United Kingdom | 123/122 A |

*Primary Examiner*—Charles J. Myhre
*Assistant Examiner*—R. H. Lazarus
*Attorney, Agent, or Firm*—Kenyon & Kenyon Reilly Carr & Chapin

[57] ABSTRACT

An internal combustion engine system, particularly as used for automotive vehicle propulsion, includes the engine with a muffler for reducing engine exhaust noise and fuelled by gas produced by a miniaturized gas reformer requiring heating and a supply of vaporized liquid hydrocarbon and oxygen-containing gas, the reformer usually being enclosed by a larger enclosure to form a space through which the engine exhaust is passed for supplying heat to the reformer, and having an exhaust heated heat-exchanger for its intake. By positioning the reformer inside of the engine's muffler so that the exhaust heat there is used to supply heat to the reformer, the need for the bulk-increasing larger enclosure is eliminated, and by arranging the intake heat-exchanger in the muffler so that the exhaust flow through the muffler is deflected both when entering and leaving the exchanger, a multi-deflected and therefore exhaust noise attenuation exhaust flow results.

5 Claims, 2 Drawing Figures

INTERNAL COMBUSTION ENGINE SYSTEM

BACKGROUND OF THE INVENTION

An internal combustion engine system ordinarily involves the engine, an exhaust muffler which, through an exhaust pipe, receives the engine's exhaust and discharges it to the atmosphere, and means for supplying the engine with a suitable fuel mixed with adequate air to support combustion in the engine.

Such a system is commonly used to power automobiles, trucks and automotive vehicles in general. The fuel normally used today is gasoline containing lead and/or aromatic hydrocarbons to provide an octane number high enough to prevent pre-ignition in the engine. The resulting engine exhaust is blamed for the current atmosphere pollution problem.

Miniaturized apparatus has been developed which produces an engine fuel in the form of gas containing carbon monoxide, methane and/or hydrogen and having a more than adequate high octane number, when the reformer is supplied with low octane fuel as exemplified by aliphatic, straight-chain hydrocarbons of short chain length, such as $C_7H_{16}$, for example. Normal anti-knocking agents, such as lead and/or aromatic hydrocarbons, need not be used with their attendant harmful atmosphere polluting effects. The use of the gas effects a substantial reduction in the engine exhaust content of nitrogen/oxide compounds which are today considered particularly objectionable as atmospheric pollutants. If the liquid fuel does contain aromatic hydrocarbons, these are decomposed into harmless components by such apparatus. The use of gasolines low in atmospherically harmful substances are generally available from existing networks of gasoline filling stations.

Such a miniaturized apparatus is hereinafter called a gas reformer. Very briefly stated, it comprises one or a series of small porous catalytic carriers which are heated and fed with a mixture of liquid hydrocarbon, such as gasoline, in vaporized form and mixed with oxygen-containing gas, such as the engine's exhaust and/or air, or a mixture of both, the output of the reformer being the gas containing carbon monoxide, methane, and/or hydrogen, which, with the addition of air, is fed to the internal combustion engine. This resulting gas is hereinafter called a reformed gas.

Each catalyst carrier is in the form of a highly porous body made of sintered particles and through which is formed a multiplicity of small holes through which the vaporized liquid fuel and oxygen containing gas mixture passes, the body containing a suitable catalyst in its pores which at elevated temperatures results in changing the liquid fuel to the gas fuel. Usually a series of such carriers are used.

Such a reformer may be compactly encased with miniaturized transverse dimensions and length, even when including possible accessory equipment. The overall dimensions permit the encased reformer to be positioned beside the engine such as under the engine hood, in normal automotive applications, as an example of its miniaturized size.

However, to heat the reformer to its elevated operating temperature, it has been enclosed by a larger heat enclosure forming a space around the reformer through which the engine exhaust is passed in heat-exchanging relation to the reformer for the latter's heating. This has the disadvantage that although the reformer is miniaturized the larger surrounding enclosure increases its overall size or bulk to an undesirable degree. This is particularly true in automotive installations where there is a large amount of already existing equipment in the engine space available. Furthermore, the reformer's intake heating, heat exchange requires piping to pass the exhaust through and from this device.

Examples of the type of reformer referred to are shown by German Pat. application Nos. P 21 03 008.0 and P 21 35 650.3 (Henkel et al., U.S. Ser. No. 270,923, filed July 12, 1972).

SUMMARY OF THE INVENTION

An object of the present invention is to provide an internal combustion engine system of the type referred to and using such a miniaturized gas reformer in a simplified form, particularly with respect to eliminating its need to be enclosed by a larger enclosure to provide a heating chamber for heating by the engine's exhaust, eliminating the need for the intake heat exchanger's piping and avoiding the need for installing the reformer within the engine space.

According to the present invention, this object is attained by positioning the gas reformer inside of the engine's exhaust muffler. The muffler may have substantially its normal dimensions so that it can be mounted in the normal manner used in automotive vehicle applications. The reformer no longer needs to be enclosed by a bulk increasing enclosure to form a heating chamber, because the muffler itself provides such a chamber for heating via the exhaust gas which passes through the muffler. According to the invention the muffler may be of the multi-deflecting type to reduce the exhaust noise; this may be done by installing the gas reformer in the muffler so that from the muffler's front end the exhaust passes through the muffler in contact with one side of the reformer substantially to the muffler's end where it is deflected transversely and passes reversely over the reformer in contact with its opposite side to an exhaust outlet adjacent to the muffler's front end. It is possible to provide a heat exchanger which deflects the exhaust flow by heat input passages through which the exhaust flows transversely to connect its two passes, with this heat exchanger having heat output passages extending longitudinally with respect to the muffler and through which the vaporized liquid fuel and oxygen-containing air may be passed via the back end of the muffler to the inlet end of the reformer where the mixture arrives in a heated condition. The reformer is compactly encased to separate it from the exhaust, but its encasement is contacted by the multi-deflected exhaust flow for heat conduction to the reformer active elements.

With this invention it becomes possible to further miniaturize the already miniaturized gas reformer because of the elimination of any need for a larger enclosure to form a heating chamber, this further miniaturization at the same time making it practical to install the reformer in the muffler. Furthermore, since the reformer absorbs heat from the engine's exhaust, the muffler is less stressed than normally and consequently has a longer than normal service life. Furthermore a more uniform heating of the reformer is made possible with a consequent improvement of the catalyst's efficiency.

Because the muffler is, in effect, divided by the reformer so that the exhaust flows along one side of the reformer, then transversely, and then reversely along the other side of the reformer to the muffler's exhaust port, the exhaust is multi-deflected so that effective exhaust noise attenuation is obtained. When the heat exchanger is used for this transverse exhaust flow, even better noise reduction is effected. For the present invention to have its maximum effectiveness, the muffler should be connected to the engine with an exhaust pipe that is as short as is permissible.

BRIEF DESCRIPTION OF THE DRAWINGS

A preferred embodiment of the present invention is schematically illustrated by the accompanying drawings in which.

DESCRIPTION OF THE PREFERRED EMBODIMENT

Figure 1:
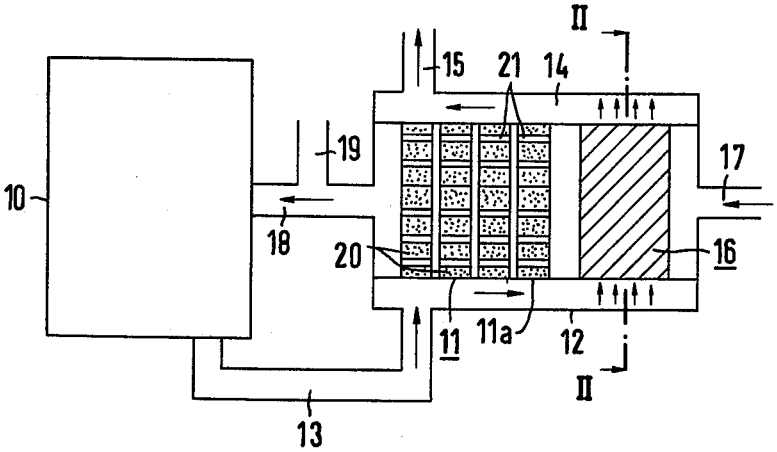
FIG. 1 is a longitudinally extending section on a vertical plane taken through the muffler installation showing the connections with the engine.
Figure 2:
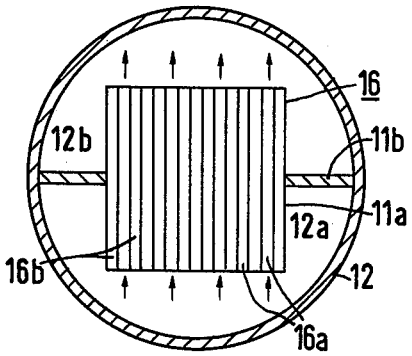
FIG. 2 is a cross section taken on the line 2—2 in FIG. 1.

The illustrated internal combustion engine system comprises the internal combustion engine 10 and the gas reformer 11 positioned in the muffler 12 with the latter positioned as close as possible to the engine 10 and connected with the latter by an exhaust pipe 13 leading from the exhaust valves (not shown) of the engine 10.

The gas reformer 11 is encased by a transversely rectangular metal casing 11*a* which extends from the front wall of the muffler to its back wall and which is positioned inside of the muffler 12 by horizontal side walls 11*b*, so the muffler is divided into a lower chamber 12*a* and an upper chamber 12*b*, the latter connecting with an exhaust pipe 15 through which the exhaust finally passes to the atmosphere. A heat exchanger 16 is positioned between the reformer 11 and the back wall of the muffler 12. This heat exchanger is of the plate type providing transverse passages 16*a* so that the exhaust from the exhaust pipe 13 enters the front end of the muffler, flows through the chamber 12*a* to the heat exchanger, upwardly through the latter's passages 16*a* and into the upper chamber 12*b* and forwardly through the latter to be ejected through the exhaust pipe 15 into the atmosphere. Thus, it can be seen that the muffler provides a multi-deflected passageway 14 providing for good exhaust noise attenuation while at the same time surrounding the metal casing of the reformer 11 with hot exhaust gas.

The vaporized liquid hydrocarbon fuel and oxygen-containing gas enter the muffler via its back wall through an inlet 17, goes through longitudinally extending heat output passages 16*b* of the heat exchanger 16 and so to the right hand or input end of the reformer 11. The reformer gas leaves the left hand or output end of the reformer 11 and goes to and through the intake 18 feeding the intake valves (not shown) of the engine 10, the required amount of air for combustion being mixed with the gas fuel by way of a pipe 19. In this way the vaporized liquid fuel and oxygen-containing gas mixture is fed to the input end of the reformer 11, heated by the exhaust heat exchanged via the heat exchanger 16.

It is conceivable that the liquid fuel vapor might be introduced or formed between the heat exchanger 16 and the back end of the muffler, such as via a vaporizer heated by the exhaust within the muffler, in which case only the oxygen-containing gas would enter through the inlet 17. As previously indicated, such gas may be in the form of a portion of the engine exhaust, or air, or a mixture of both.

The gas reformer comprises a series of blocks 20 heated by the exhaust as previously described and made of porous material and carrying a catalytic agent, these blocks having a multiplicity of relatively small holes 21 extending longitudinally with respect to the muffler, parallel to each other, and through which the heated vaporized liquid fuel and oxygen-containing gas pass, the output of the reformer fed to the engine's intake pipe 18 being the reformed gas containing carbon monoxide, methane and/or hydrogen.

The possible miniaturization of the gas reformer is illustrated by the fact that, for example, its catalytic chamber portion may have inside dimensions of only about 80 mm × 80 mm × 215 mm, or a volume of only about 1.4 liter. The catalytic elements comprise in this instance four of the blocks 20 which are each 50 mm thick, so they may be considered as plates, interspaced from each other 5 mm. The plates are made of a highly porous material such as sintered particles of aluminum oxide or magnesium-aluminum silicate. The pore volume of these sintered plates is from 20 to 60% preferably from 40 to 50%; the holes 21, or passages, may have diameters in the range of 0.1 to 2 mm, these passages not only serving to pass the fluid flow, but also to transport it to the catalytic active centers which are located in the pores of the sintered plates. The number of the holes 21 per $cm^2$ of the plate surface area depends on their diameter; for example, for a hole diameter of 1 mm, each one $cm^2$ of the plate area has about 40 holes for an area 80 mm × 80 mm.

The reformer can accommodate fuels such as aliphatic, straight-chain hydrocarbons of short chain length and, therefore, low-octane number; an example is $C_7H_{16}$. The fuel does not need to contain anti-knocking agents, such as a lead and aromatic hydrocarbons, which in conventional engine operation cause serious atmospheric pollution problems. Gasoline low in such substances may be used. However, if the gasoline contains aromatic hydrocarbons, the latter are decomposed to harmless components by the action of the reformer. Because of the reformer the engine operates on the reformed gas containing carbon monoxide, methane and/or hydrogen, this effecting a substantial reduction of nitrogen-oxide compounds which are considered very harmful as an atmospheric pollutant. Since fuels low in harmful substances can be used and no anti-knock components need be added to the fuel, the costs of producing the fuel at the refinery are reduced.

The catalyst in the pores of the porous plates 20 can be a nickel catalyst, a platinum catalyst or nickel-platinum mixed catalyst. In each case the catalyst makes the change of the vaporized liquid fuel and oxygen-containing gas into the reformed gas containing monoxide, methane and/or hydrogen possible when adequately elevated temperatures are maintained. Nickel sponge can be used to advantage, i.e., nickel with a large active surface which does not sinter together at the operating temperatures of the catalyst. The gas produced from gasoline of low octane value, has a high number of over a 100, approximately in the range of 110. Therefore, the gas produced by the reformer can be used to operate even a high compression automotive engine without knocking problems.

To preserve the active centers of the catalyst in the porous plates of the reformer, the catalyst may be doped with uranium. Highly suitable catalysts are disclosed in the German Pat. applications Nos. P 22 10 365.7 and P 22 10 401.4.

Such catalysts are active at operating temperatures of from 300° to 500°C. For example, when the plates 20 are sintered from aluminum oxide particles to provide the porosity previously referred to, with the pores containing platinum as the catalyst, using about 5 mg of platinum per $cm^3$ of the plate material, a starting temperature for the catalyst action is about 120°C, the reforming temperature for producing the reformed gas being about 420° to 480° under continuing operating conditions.*) To attain the starting temperature, igniting means may be included as a part of the reformer equipment.

*) The upper temperature limit may be about 800° without decreasing the life time of the catalyst.

The casing 11*a* is shown as extending for the full length of the muffler, from its front to its back walls. Therefore, the heat exchanger 16 is made with the same transverse dimensions, height and width, as the bodies or plates 20. Although not shown, the exchanger's heat input passages 16*a*, of course, open through the casing's bottom and top walls to pass the exhaust from chamber 12*a* to chamber 12*b*. At the muffler's back end portion the casing separates the mixture introduced through the inlet 17 from the engine exhaust in the muffler, and performs the same function from the outlet side of the heat exchanger onto the muffler's front end to the engine fuel intake conduit 18.

What is claimed is:

1. An internal combustion engine system including an internal combustion engine having a single muffler used for reducing engine noise through which the engine's exhaust passes and a reformer having an intake end fed by vaporized liquid hydrocarbon fuel mixed with an oxygen-containing gas and an output end from which the reformer's gas output is fed to the engine intake wherein the improvement comprises the reformer positioned inside the muffler and wherein the inside of said muffler is divided into an upper and lower chamber and further including a heat exchanger of the plate type having a plurality of transverse passages connecting said lower and upper chambers forming heat input flow passages and having a plurality of longitudinal heat output flow passages, means for conducting said exhaust into one of said upper and lower chambers and out of the other of said chambers after it flows through said heat input flow passages and means for conducting at least the oxygen containing gas from outside the muffler through said heat output flow passages to the reformer intake end while separated from the exhaust in the muffler, whereby said plurality of transverse heat input flow passages through which said exhaust flows will act to both transfer large amounts of heat and at the same time provide for good exhaust noise attenuation.

2. The system of claim 1 in which the muffler is connected to the engine by an exhaust pipe short enough to prevent the exhaust from cooling therein to a degree preventing effective heating of the reformer.

3. The system of claim 1 in which said muffler is of the size of a conventional automobile engine muffler and in which said reformer is of the type comprising an encased series of porous plates carrying a catalytic agent and having passages through which the vaporized fuel and oxygen containing gas is passed, permitting the reformer to be miniaturized to a degree permitting it to be mounted in the muffler, and the dimensions of the heat exchanger being of substantially the same cross-sectional size as the reformers cross sectional size.

4. The system of claim 3 in which the reformer is encased by a metal casing over which the exhaust flows while in the muffler.

5. The system of claim 4 in which the muffler contains means for multi-deflecting the exhaust flowing therethrough.

* * * * *